US009861197B2

(12) United States Patent
Chen et al.

(10) Patent No.: US 9,861,197 B2
(45) Date of Patent: Jan. 9, 2018

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-ho Yang, Kaohsiung (TW); Chien-Li Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/621,847

(22) Filed: Feb. 13, 2015

(65) Prior Publication Data

US 2016/0235196 A1 Aug. 18, 2016

(51) Int. Cl.

*A47B 88/04* (2006.01)
*A47B 88/493* (2017.01)
*A47B 88/43* (2017.01)

(52) U.S. Cl.

CPC ..... *A47B 88/493* (2017.01); *A47B 88/43* (2017.01)

(58) Field of Classification Search

CPC ..... A47B 55/00; A47B 96/07; A47B 88/04; A47B 88/0407; A47B 88/43; A47B 88/493

USPC ..... 312/330.1, 334.1, 334.7, 334.8, 334.4; 211/190

See application file for complete search history.

(56) References Cited

U.S. PATENT DOCUMENTS 6,230,903 B1 * 5/2001 Abbott ..... H05K 7/1421 211/190
6,863,188 B2 * 3/2005 Besserer ..... H02B 1/34 211/175
8,721,012 B2 5/2014 Chen et al.
8,733,866 B2 5/2014 Chen et al.
2001/0040142 A1 * 11/2001 Haney ..... A47B 88/044 211/183
2006/0152115 A1 7/2006 Dubon et al.
2012/0087605 A1 * 4/2012 Chen ..... A47B 88/08 384/42
2012/0087606 A1 * 4/2012 Chen ..... A47B 88/08 384/42
2012/0128278 A1 * 5/2012 Chen ..... A47B 88/04 384/26
2013/0161468 A1 * 6/2013 Chen ..... H05K 7/1489 248/298.1

* cited by examiner

*Primary Examiner* — James O Hansen
(74) *Attorney, Agent, or Firm* — Rosenberg, Klein & Lee

(57) ABSTRACT

A slide rail assembly adapted to mount an object to a rack includes first through third rails. The first rail is mounted to the rack. The second rail is movably connected to the first rail and includes a reinforcement structure having a first portion and a second portion opposite the first portion. The third rail is movably connected to the second rail. When the slide rail assembly is in a fully pulled out position, each of the second and third rails is at an extended position with respect to the first rail, the second rail is located between the first and third rails, and the first and second portions of the reinforcement structure correspond in position to the third and first rails respectively.

10 Claims, 8 Drawing Sheets

SLIDE RAIL ASSEMBLY

FIELD OF THE INVENTION

The present invention relates to a slide rail assembly and more particularly to a slide rail assembly with a reinforcement structure.

BACKGROUND OF THE INVENTION

FIG. 1 shows how a pair of slide rail assemblies 100 are mounted to a rack 102 in a conventional server system. Typically, each slide rail assembly 100 includes a first rail 104, a second rail 106, and a third rail 108 sequentially connected together, wherein the second rail 106 and the third rail 108 can be longitudinally displaced relative to the first rail 104. An object 110 (e.g., a server or other electronic equipment) is mounted between the third rails 108 of the pair of slide rail assemblies 100. When the third rail 108 of each slide rail assembly 100 is fully pulled out and therefore at an extended position with respect to the first rail 104, the second rail 106 is also at an extended position with respect to the first rail 104 and is located between the first rail 104 and the third rail 108.

Referring to FIG. 2 in conjunction with FIG. 1, when the third rail 108 of each slide rail assembly 100 is fully pulled out and at the extended position with respect to the first rail 104, it is often the case that the third rail 108 has been pulled excessively with respect to the first rail 104, meaning the rear section 108*a* of the third rail 108 is a distance D away from the front section 104*a* of the first rail 104. Consequently, the weight of the object 110 mounted on the third rails 108 is borne mostly by the second rails 106, which tend to deform or bend if this weight bearing arrangement occurs repeatedly or lasts for a long time. In an environment where the object 110 and the rack 102 have fixed specifications, therefore, finding a way to structurally reinforce specific portions of the slide rail assemblies 100 in the limited space available is an important issue in improving the slide rail assemblies 100 in terms of use.

SUMMARY OF THE INVENTION

The present invention relates to a slide rail assembly with a reinforcement structure.

According to one aspect of the present invention, a slide rail assembly includes a first rail, a second rail, and a third rail. The second rail is movably connected to the first rail and includes a reinforcement structure, wherein the reinforcement structure includes a first portion and a second portion opposite the first portion. The third rail is movably connected to the second rail. When the slide rail assembly is in a fully pulled out position, each of the second rail and the third rail is at an extended position with respect to the first rail, the second rail is located between the first rail and the third rail, the first portion of the reinforcement structure is at a position corresponding to the third rail, and the second portion of the reinforcement structure is at a position corresponding to the first rail.

According to another aspect of the present invention, a slide rail assembly adapted for mounting an object to a rack includes a first rail, a second rail, and a third rail. The first rail is mounted to the rack. The second rail is movably connected to the first rail and includes a reinforcement structure, wherein the reinforcement structure includes a first portion and a second portion opposite the first portion. The third rail is movably connected to the second rail and is mounted with the object. When the slide rail assembly is in a fully pulled out position, each of the second rail and the third rail is at an extended position with respect to the first rail, the second rail is located between the first rail and the third rail, the first portion of the reinforcement structure is at a position corresponding to the third rail, and the second portion of the reinforcement structure is at a position corresponding to the first rail.

According to yet another aspect of the present invention, a slide rail assembly includes a first rail, a second rail, and a third rail. The second rail is located between the first rail and the third rail and includes an upper wall, a lower wall, and a sidewall extending and connected between the upper wall and the lower wall. The sidewall includes a first surface and a second surface opposite the first surface. The first surface faces the third rail while the second surface faces the first rail. The second rail further includes a reinforcement structure connected to the second rail and located between the second surface of the second rail and the first rail.

In some embodiments of any of the above aspects, the reinforcement structure is a plate longitudinally and fixedly connected to the second rail. Alternatively, in other embodiments, the reinforcement structure is longitudinally and integrally formed with the second rail and is in the form of a rib.

In some embodiments of any of the above aspects, the second rail includes a front portion and a rear portion, and the reinforcement structure is located between the front portion and the rear portion.

In some embodiments of any of the above aspects, the first rail is mounted to the rack via two brackets.

In some embodiments of any of the above aspects, the second rail further includes a recess in the second surface, and the reinforcement structure is fixedly connected to the second rail and located in the recess.

One of the advantageous features of employing the present invention is that the reinforcement structure increases the structural strength of the second rail.

BRIEF DESCRIPTION OF THE DRAWINGS

The structure as well as a preferred mode of use and the advantages of the present invention will be best understood by referring to the following detailed description of some illustrative embodiments in conjunction with the accompanying drawings, in which.

DETAILED DESCRIPTION OF THE INVENTION

Figure 1:
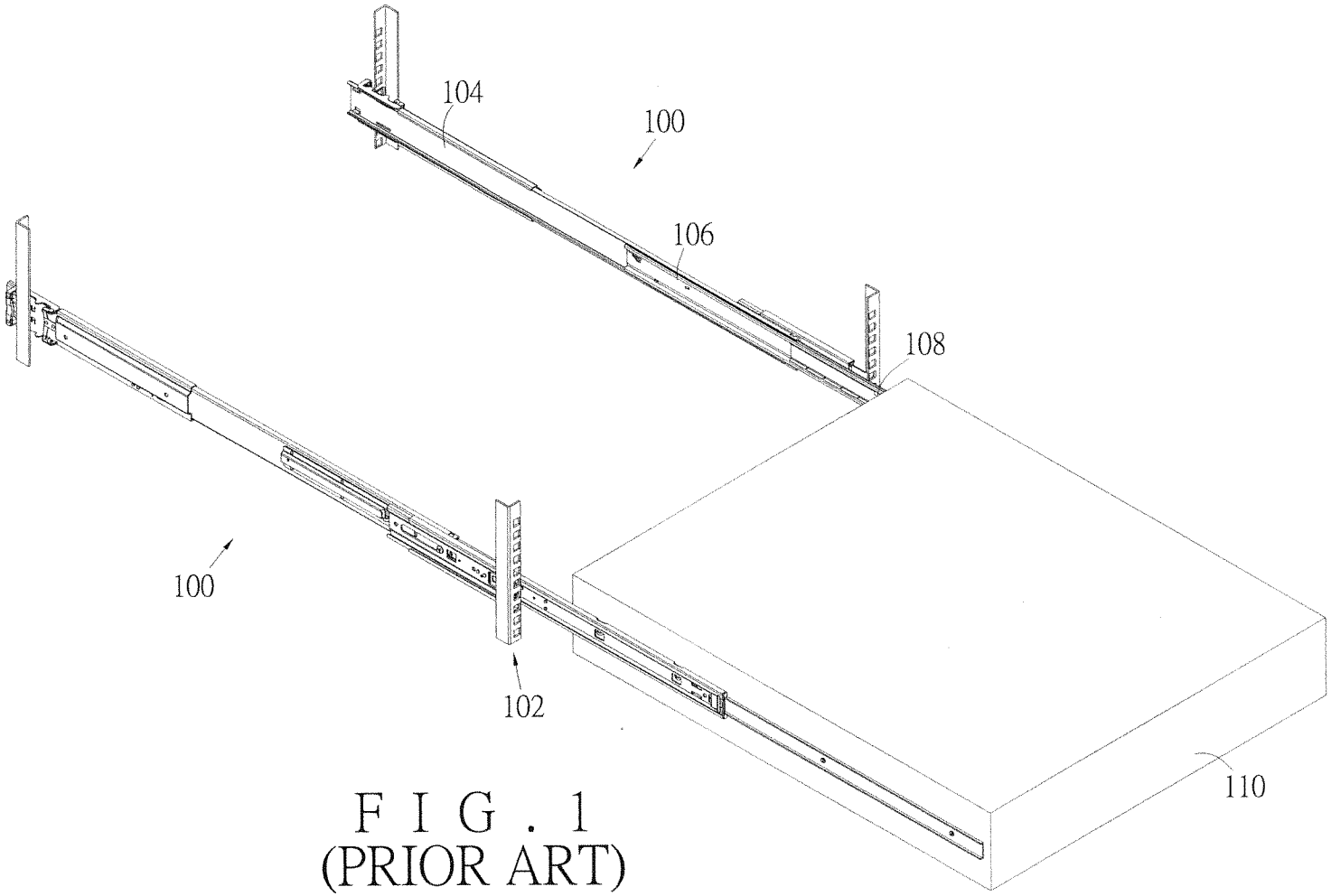
FIG. 1 (PRIOR ART)
FIG. 1 is a schematic perspective view in which a pair of conventional slide rail assemblies are mounted to a rack, and in which an object is mounted on a corresponding pair of rails of the slide rail assemblies.
Figure 2:
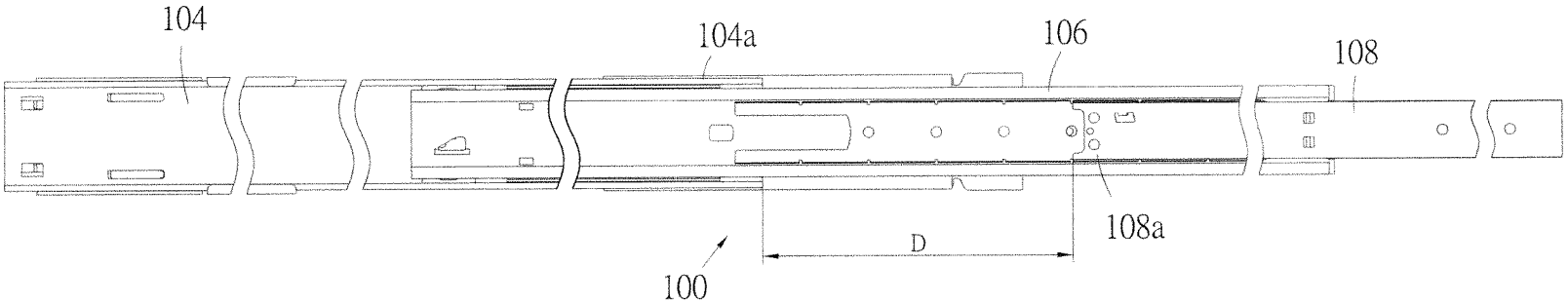
FIG. 2 (PRIOR ART)
FIG. 2 schematically shows one of the conventional slide rail assemblies in FIG. 1 in an extended state, in which the third rail is a certain distance away from the first rail.
Figure 3:
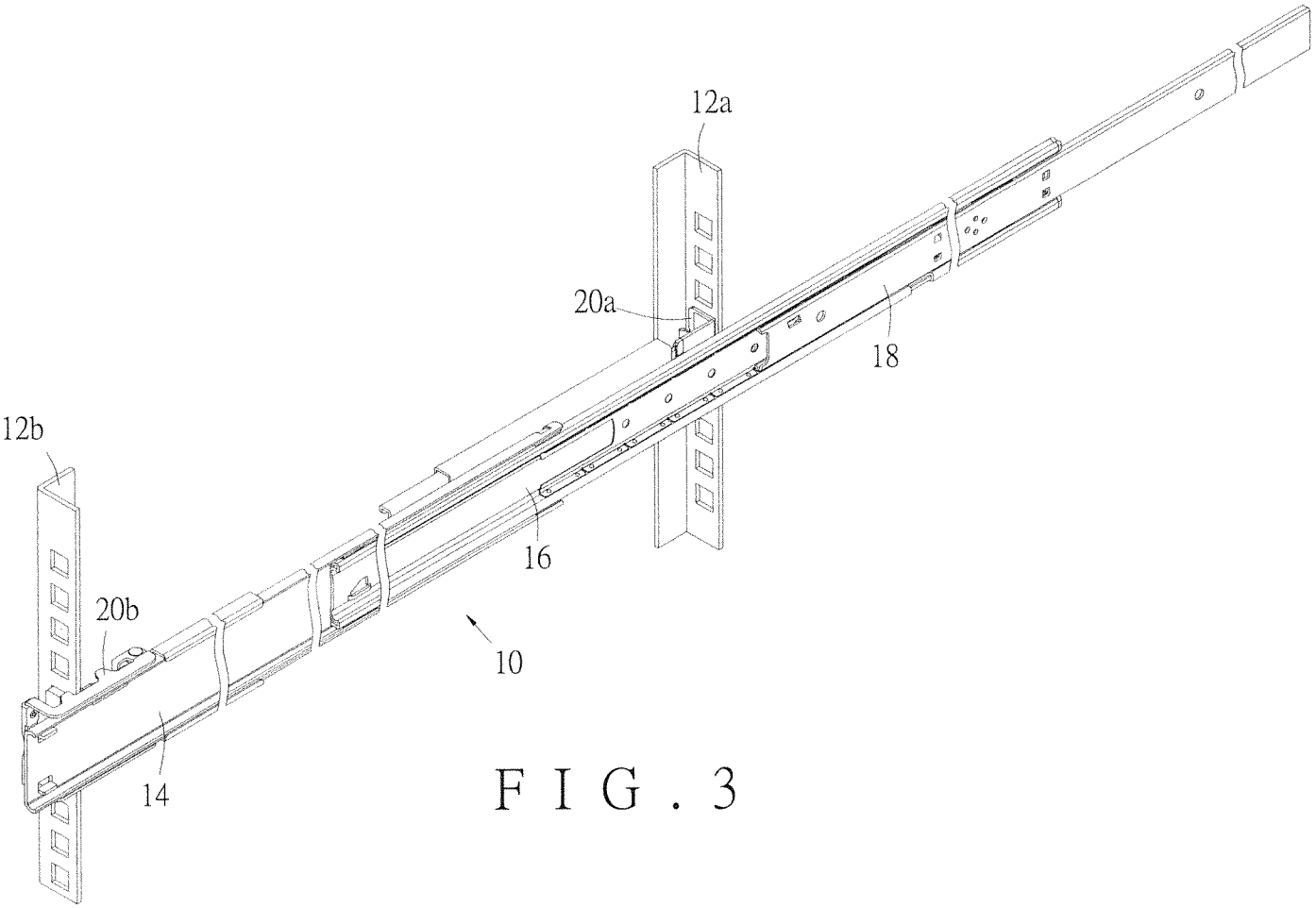
FIG. 3 is a schematic perspective view in which the slide rail assembly in an embodiment of the present invention is mounted to a rack and is in an extended state.

Referring to FIG. 3, the slide rail assembly 10 in an embodiment of the present invention is applied to a first post 12*a* and a second post 12*b* of a rack and is in an extended state. More specifically, the slide rail assembly 10 includes a first rail 14, a second rail 16, and a third rail 18. The first rail 14 has two portions (e.g., a front portion and a rear portion) which are mounted to the first post 12*a* and the second post 12*b* via a first bracket 20*a* and a second bracket 20*b* respectively. The second rail 16 is movably connected to the first rail 14 and is shown in FIG. 3 as at an extended position with respect to the first rail 14. The third rail 18 is movably connected to the second rail 16 and is shown in FIG. 3 as at an extended position with respect to the second rail 16. It should be pointed out that the slide rail assembly 10 can be brought to a retracted state as well and is shown herein in the extended state solely to demonstrate the features of this embodiment of the present invention.

Figure 4:
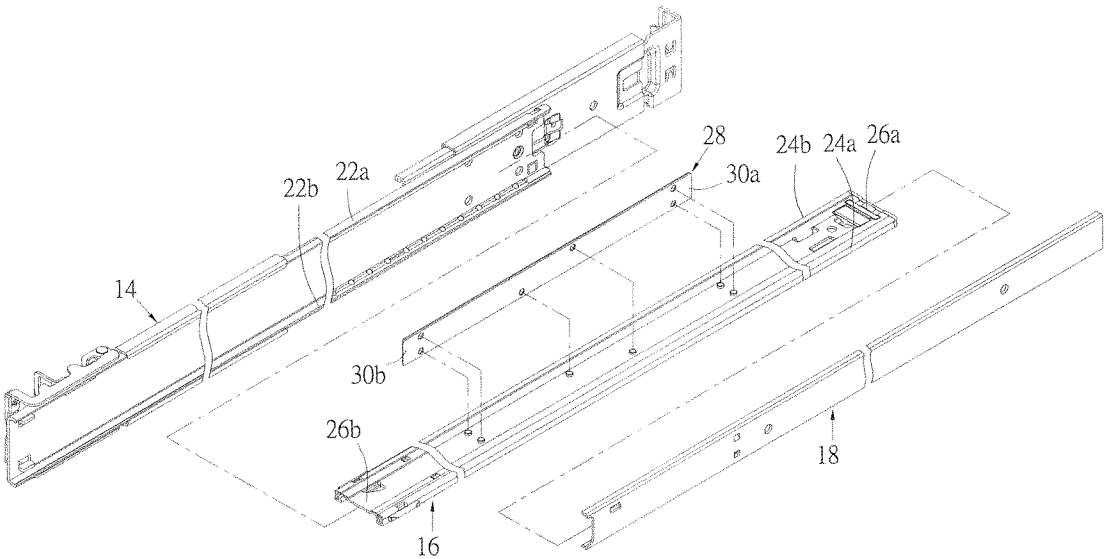
FIG. 4 is a schematic exploded view of the slide rail assembly in FIG. 3, showing in particular the reinforcement structure of the second rail.

FIG. 4 is an exploded view of the first rail 14, the second rail 16, and the third rail 18. The first rail 14 includes an upper wall 22*a* and a lower wall 22*b*. The second rail 16 includes an upper wall 24*a*, a lower wall 24*b*, a front portion 26*a*, a rear portion 26*b*, and a reinforcement structure 28 correspondingly connected to the second rail 16 and located between the front portion 26*a* and the rear portion 26*b*. The reinforcement structure 28 includes a first portion 30*a* and a second portion 30*b*. The second portion 30*b* is located opposite the first portion 30*a*. In this embodiment, the reinforcement structure 28 is a plate by way of example, wherein the plate can be an elongated one or other structure extending for a certain length. The present invention imposes no limitations on the form of the reinforcement structure 28. The reinforcement structure 28 is longitudinally, correspondingly, and fixedly connected to the second rail 16 and can therefore be viewed as a part of the second rail 16.

Figure 5:
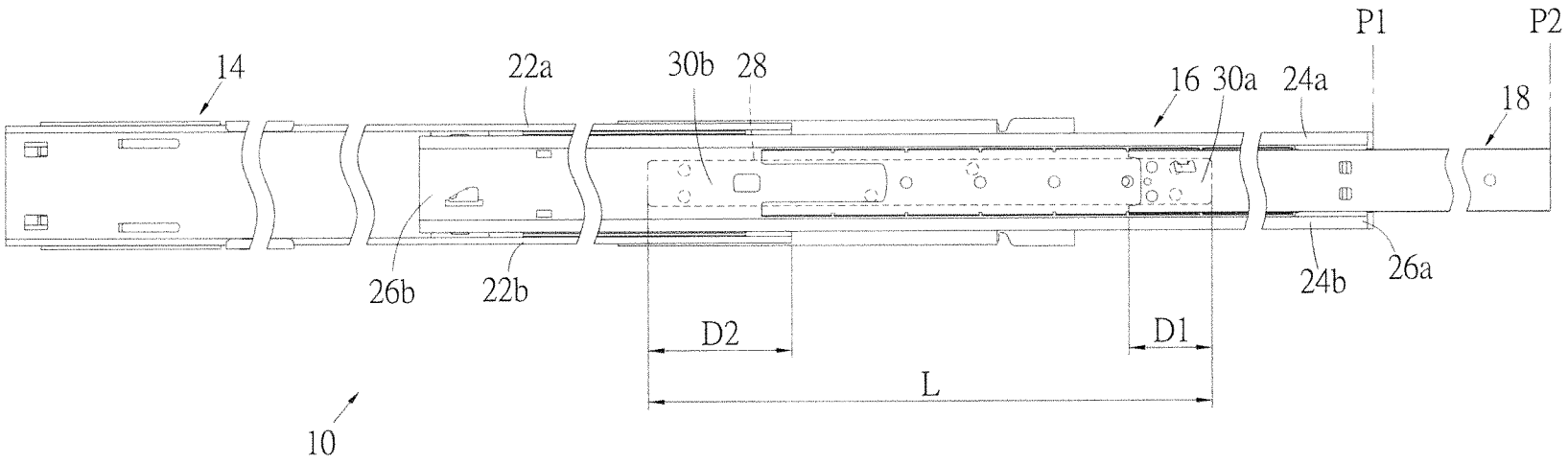
FIG. 5 is a schematic drawing in which the slide rail assembly in FIG. 3 is in a fully pulled out position, and in which the reinforcement structure has two portions corresponding to the first rail and the third rail respectively.

In FIG. 5, the slide rail assembly 10 is in a fully pulled out position, or in an extended state, in which the second rail 16 is at a first extended position P1 with respect to the first rail 14 while the third rail 18 is at a second extended position P2 with respect to the first rail 14, and the second rail 16 is located between the first rail 14 and the third rail 18. More specifically, the rear portion 26*b* of the second rail 16 is supported between the upper wall 22*a* and the lower wall 22*b* of the first rail 14, and the third rail 18 is supported between the upper wall 24*a* and the lower wall 24*b* of the second rail 16 and has a portion located at the front portion 26*a* of the second rail 16. The reinforcement structure 28 has a length L. When the slide rail assembly 10 is in the extended state, the first portion 30*a* of the reinforcement structure 28 is at a position corresponding to the third rail 18. For example, the first portion 30*a* of the reinforcement structure 28 corresponds to the third rail 18 in such a way that they overlap each other by a first distance D1. On the other hand, the second portion 30*b* of the reinforcement structure 28 is at a position corresponding to the first rail 14. For example, the second portion 30*b* of the reinforcement structure 28 corresponds to the first rail 14 in such a way that they overlap each other by a second distance D2. Thus, the reinforcement structure 28 enhances the structural strength of the second rail 16 and consequently the connection strength between the third rail 18 and the first rail 14, protecting the second rail 16 from deformation or bending which may otherwise occur due to the weight of the object mounted on the third rail 18 as a result of the third rail 18 being pulled out excessively.

Figure 6:
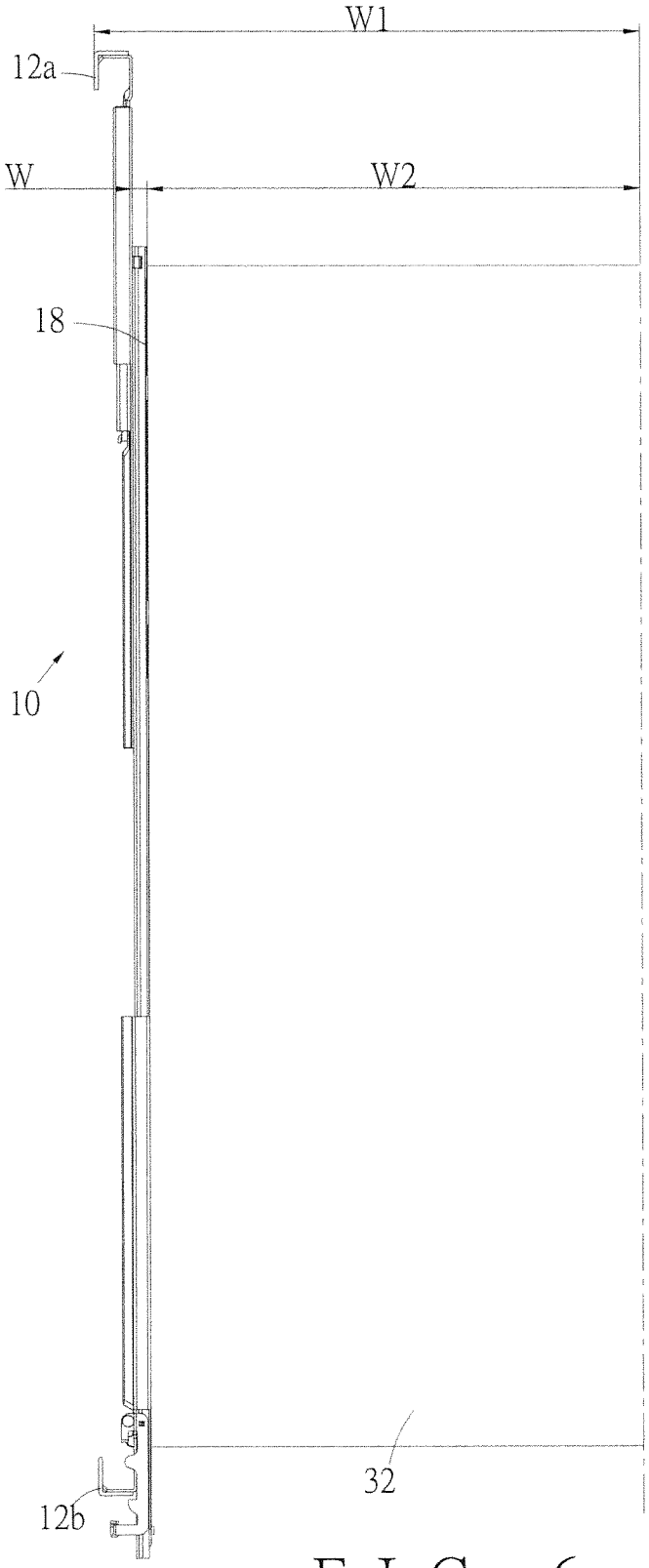
FIG. 6 schematically shows the width of the slide rail assembly in FIG. 3 and how the slide rail assembly is used between a rack and an object which have fixed specifications.

Referring to FIG. 6, an object 32 is mounted to the first post 12*a* and the second post 12*b* of a rack via the slide rail assembly 10, wherein the object 32 is mounted to the third rail 18. More specifically, the rack (the first post 12*a* or the second post 12*b*) and the object 32 have a total width W1, and the object 32 has a width W2. Therefore, in an environment where the specifications of the object 32 and of the rack are fixed, the slide rail assembly 10 can only have a fixed width W.

Figure 7:
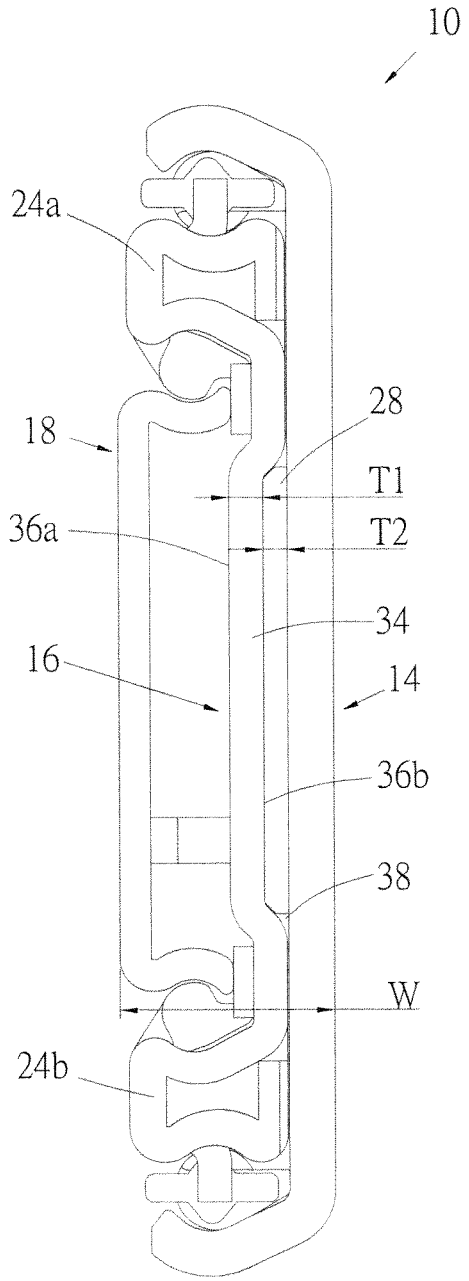
FIG. 7 is a schematic assembled view of the slide rail assembly in FIG. 3.

FIG. 7 shows, from another perspective, the first rail 14, the second rail 16, and the third rail 18 of the slide rail assembly 10 in the assembled state, in which the slide rail assembly 10 has the fixed width W. The second rail 16 includes a sidewall 34 extending and connected between the upper wall 24*a* and the lower wall 24*b*. The sidewall 34 includes a first surface 36*a* and a second surface 36*b* opposite the first surface 36*a*. The first surface 36*a* faces the third rail 18 while the second surface 36*b* faces the first rail 14. The reinforcement structure 28 is connected to the second surface 36*b* of the second rail 16 and is located between the second surface 36*b* of the second rail 16 and the first rail 14. In this embodiment, the second rail 16 has a first thickness T1 and further includes a recess 38 in the second surface 36*b*. Given the limited width W of the slide rail assembly 10, the recess 38 of the second rail 16 allows the reinforcement structure 28 to have a second thickness T2, be fixedly connected to the second rail 16, and lie in the recess 38. And thanks to the reinforcement structure 28, the section of the second rail 16 that is provided with the reinforcement structure 28 is increased in thickness, and the structural strength of a specific portion of the second rail 16 is thus enhanced.

Figure 8:
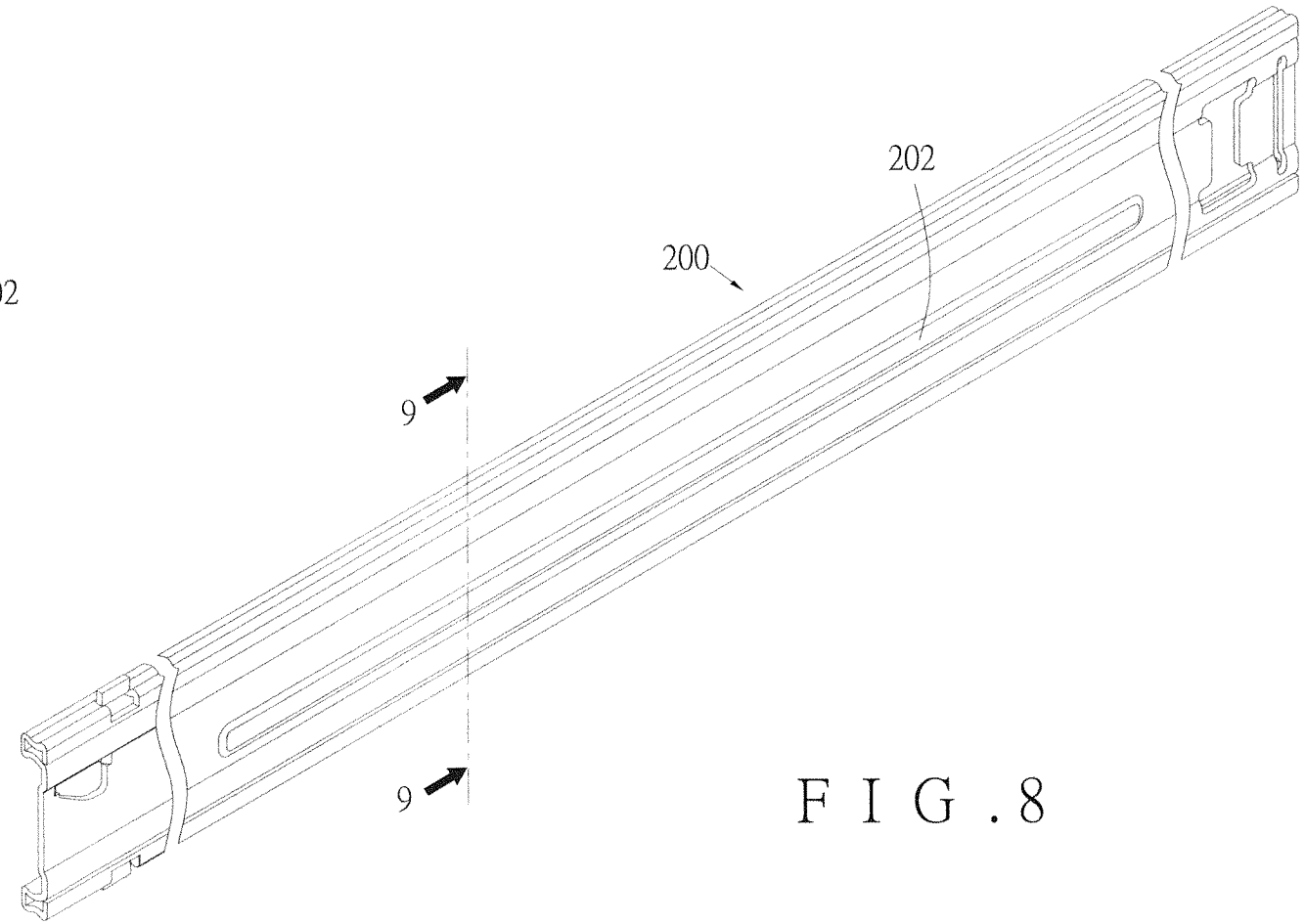
FIG. 8 is a schematic perspective view of another embodiment of the present invention, in which the second rail is directly and integrally formed with a reinforcement structure.
Figure 9:
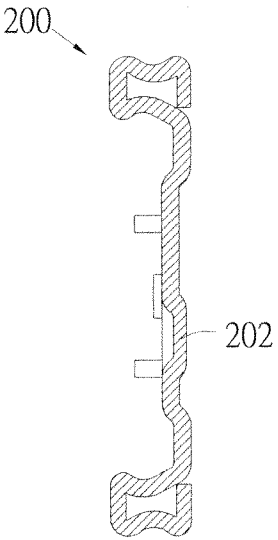
FIG. 9 is a schematic sectional view taken along line 9-9 of FIG. 8.

FIG. 8 and FIG. 9 show another embodiment of the present invention, in which the second rail 200 of the slide rail assembly is directly and integrally formed with a reinforcement structure 202. In this embodiment, the reinforcement structure 202 is longitudinally and integrally formed with the second rail 200 and is in the shape of a rib by way of example. The rib increases the structural strength of the second rail 200 and provides the second rail 200 with higher resistance to bending.

While the present invention has been disclosed through the preferred embodiments described above, the embodiments are not intended to be restrictive of the present invention. The scope of patent protection sought by the applicant is defined by the appended claims.

The invention claimed is:

1. A slide rail assembly, comprising:

a first rail coupled to extend between first and second posts of a rack by first and second bracket assemblies;

a second rail movably connected to the first rail to slidably displace between retracted and extended positions relative thereto, the second rail including a longitudinally extended reinforcement structure to increase structural strength thereof, wherein the reinforcement structure includes a first portion and a second portion longitudinally opposed to the first portion and wherein the second rail further includes a longitudinally extended recess formed in a surface of the second rail facing the first rail, and the reinforcement structure is fixedly connected to the second rail within the recess to be peripherally disposed within the second rail, the reinforcement structure thereby remaining longitudinally contained within the second rail; and a third rail movably connected to the second rail to slidably displace between retracted and extended positions relative thereto;

wherein the reinforcement structure is captured at least partially between the second and each of the first and third rails, and is displaceable with the second rail relative to the first and third rails, and wherein, when the slide rail assembly is in a fully extended state with both of the second and third rails disposed at the extended positions thereof, the second rail is located between the first rail and the third rail with the reinforcement structure projecting partially into both the first and third rails, the first portion of the reinforcement structure being thereby at a position corresponding to overlapping portions of the third and second rails, and the second portion of the reinforcement structure being thereby at a position corresponding to overlapping portions of the first and second rails.

2. The slide rail assembly of claim 1, wherein the reinforcement structure is a plate longitudinally and fixedly connected to the second rail.

3. The slide rail assembly of claim 1, wherein the reinforcement structure is longitudinally and integrally formed with the second rail and comprises a rib located in the recess of the second rail.

4. A slide rail assembly adapted for mounting an object to a rack, the slide rail assembly comprising:

a first rail coupled to extend between first and second posts of a rack by first and second bracket assemblies;

a second rail movably connected to the first rail to slidably displace between retracted and extended positions relative thereto, the second rail including a longitudinally extended reinforcement structure to increase structural strength thereof, wherein the reinforcement structure includes a first portion and a second portion longitudinally opposed to the first portion and wherein the second rail further includes a longitudinally extended recess formed in a surface of the second rail facing the first rail, and the reinforcement structure is fixedly connected to the second rail within the recess to be peripherally disposed within the second rail, the reinforcement structure thereby remaining longitudinally contained within the second rail; and a third rail movably connected to the second rail to slidably displace between retracted and extended positions relative thereto and mounted with the object;

wherein the reinforcement structure is captured at least partially between the second and each of the first and third rails, and is displaceable with the second rail relative to the first and third rails, and wherein when the slide rail assembly is in a fully extended state with both of the second and third rails disposed at the extended positions thereof, the second rail is located between the first rail and the third rail with the reinforcement structure projecting partially into both the first and third rails, the first portion of the reinforcement structure being thereby at a position corresponding to overlapping portions of the third and second rails, and the second portion of the reinforcement structure being thereby at a position corresponding to overlapping portions of the first and second rails.

5. The slide rail assembly of claim 4, wherein the reinforcement structure is a plate longitudinally and fixedly connected to the second rail.

6. The slide rail assembly of claim 4, wherein the reinforcement structure is longitudinally and integrally formed with the second rail and comprises a rib located in the recess of the second rail.

7. The slide rail assembly of claim 4, wherein the first rail is mounted to the rack via two brackets.

8. A slide rail assembly, comprising;

a first rail coupled to extend between first and second posts of a rack by first and second bracket assemblies;

a second rail slidably displaceable between retracted and extended positions relative to the first rail; and a third rail slidably displaceable between retracted and extended positions relative to the second rail;

wherein the second rail is located between the first rail and the third rail and includes an upper wall, a lower wall, and a sidewall extending and connected between the upper wall and the lower wall, the sidewall including a first surface and a second surface opposite the first surface, the first surface facing the third rail, the second surface facing the first rail, wherein the second rail further includes a recess formed in the second surface and a longitudinally extended reinforcement structure is fixedly connected to the second rail within the recess to be peripherally disposed within the second rail, the reinforcement structure thereby remaining longitudinally contained within the second rail and captured at least partially between the second and each of the first and third rails, and displaceable with the second rail relative to the first and third rails, and wherein, when the slide rail assembly is in a fully extended state with both of the second and third rails disposed at an extended positions thereof, the second rail is located between the first rail and the third rail with the reinforcement structure projecting partially into both the first and third rails, a first portion of the reinforcement structure being thereby at a position corresponding to overlapping portions of the third and second rails, and a second portion of the reinforcement structure being thereby at a position corresponding to overlapping portions of the first and second rails.

9. The slide rail assembly of claim 8, wherein the reinforcement structure is a plate connected to the second rail.

10. The slide rail assembly of claim 8, wherein the reinforcement structure is longitudinally and integrally formed with the second rail and comprises a rib located in the recess of the second rail.

* * * * *